US008133003B2

(12) United States Patent
Davi et al.

(10) Patent No.: US 8,133,003 B2
(45) Date of Patent: Mar. 13, 2012

(54) MAGNETIC ADJUSTMENT OF TURBOMACHINERY COMPONENTS

(75) Inventors: Michael Alan Davi, Niskayuna, NY (US); David Andrew Stasenko, Albany, NY (US)

(73) Assignee: General Electric Company, Schenectady, NY (US)

( * ) Notice: Subject to any disclaimer, the term of this patent is extended or adjusted under 35 U.S.C. 154(b) by 742 days.

(21) Appl. No.: 12/239,010

(22) Filed: Sep. 26, 2008

(65) Prior Publication Data

US 2010/0080691 A1 Apr. 1, 2010

(51) Int. Cl.
*F01D 11/22* (2006.01)

(52) U.S. Cl. ..... 415/1; 415/14; 415/118; 415/173.1; 415/173.2; 415/174.4; 415/174.2; 415/174.5; 277/303; 277/412; 277/415

(58) Field of Classification Search ..... 415/1, 14, 415/118, 173.1–173.6, 174.1, 174.2, 174.5, 415/230, 231; 277/303, 412, 414, 415
See application file for complete search history.

(56) References Cited

U.S. PATENT DOCUMENTS

| | | | | |
|---|---|---|---|---|
| 5,263,816 | A * | 11/1993 | Weimer et al. | 415/131 |
| 6,375,411 | B1 * | 4/2002 | Ham et al. | 415/10 |
| 6,746,019 | B1 * | 6/2004 | Liebenberg et al. | 277/410 |
| 2004/0100035 | A1 * | 5/2004 | Turnquist et al. | 277/412 |

* cited by examiner

*Primary Examiner* — Benjamin Sandvik
*Assistant Examiner* — Krista Soderholm
(74) *Attorney, Agent, or Firm* — Cantor Colburn LLP

(57) ABSTRACT

Disclosed is a seal for a turbomachine including at least one fixed component located proximate to a rotating component of the turbomachine defining a clearance therebetween. At least one magnet is located at the at least one fixed component. The at least one magnet is, when activated, capable of moving the at least one fixed component thereby adjusting the clearance between the fixed component and the rotating component. Further disclosed is a turbomachine utilizing the seal and a method for adjusting a position of at least one fixed component of a turbomachine.

20 Claims, 5 Drawing Sheets

MAGNETIC ADJUSTMENT OF TURBOMACHINERY COMPONENTS

BACKGROUND

The subject invention relates generally to turbomachinery. More particularly, the subject invention relates to adjustment of turbomachinery components via magnetic forces.

Turbomachinery typically includes seals which are utilized to control clearances between rotating components and non-rotating components of the turbomachine. Examples of turbomachine seals include tip shrouds outboard of rotating bucket rows, and single or multi-tooth seals typically utilized between rows of fixed blades and a rotating shaft. During certain operating conditions, such as startup or shutdown and during transients, vibration and/or thermal growth of components may cause excessive wear to the seals and/or damage to other turbomachine components. Excessive wear of the seals shortens their useful life and also causes an increase in leakage of flow in the turbomachine which decreases the turbomachine's efficiency.

Control of clearance between the seals and rotating components is typically achieved through the use of radial and/or tangential springs to bias a seal's location. Seal position is sometimes controlled through the use of hydraulic or pneumatic actuators. The actuators, though, located outside of the casing of the turbomachine, require penetration through the casing of the turbomachine, which increases cost and potentially increases leakage through the casing.

BRIEF DESCRIPTION OF THE INVENTION

According to one aspect of the invention, a seal for a turbomachine includes at least one fixed component located proximate to a rotating component of the turbomachine defining a clearance therebetween. At least one magnet is located at the at least one fixed component. The at least one magnet is, when activated, capable of moving the at least one fixed component thereby adjusting the clearance between the fixed component and the rotating component.

According to another aspect of the invention, a turbomachine includes a casing and at least one rotating component located in the casing and rotatable about a central axis of the turbomachine. At least one fixed component is located in the casing to define a clearance between the at least one rotating component and the at least one fixed component, and at least one magnet located such that when the at least one magnet is activated, the clearance between the at least one rotating component and the at least one fixed component is adjusted.

According to yet another aspect of the invention, a method for adjusting a position of at least one fixed component of a turbomachine includes locating at least one magnet proximate to the at least one fixed component and activating the at least one magnet thereby creating a magnetic field in magnetic communication with the at least one fixed component. The at least one fixed component is moved via the magnetic field.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
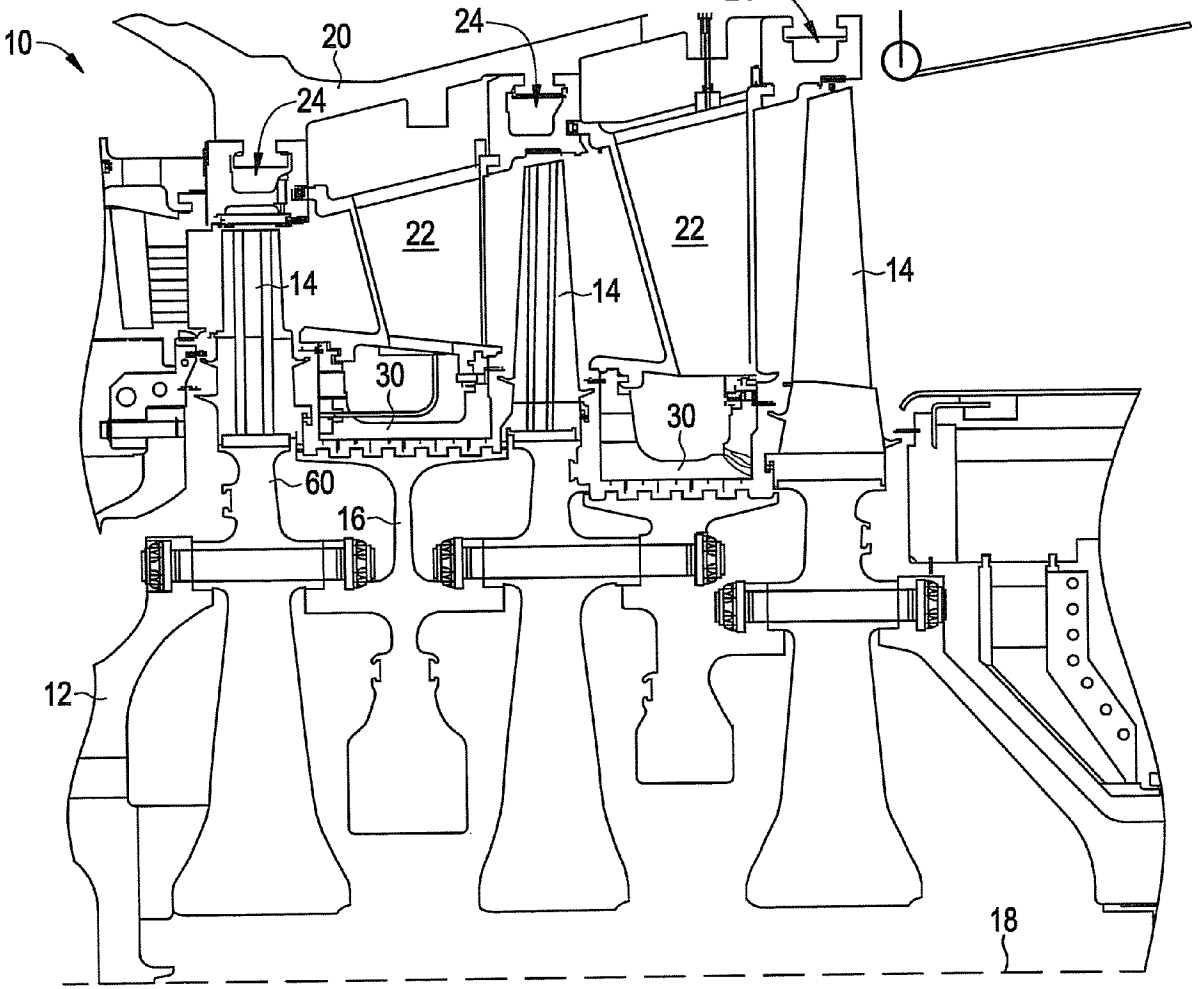
FIG. 1 is a cross-sectional view of an embodiment of a turbomachine.
Figure 2:
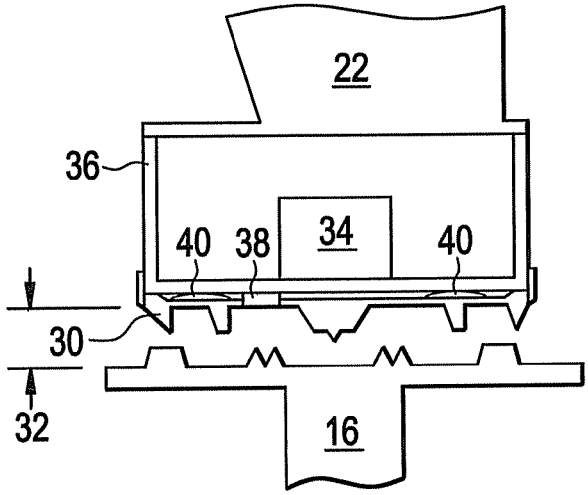
FIG. 2 is a cross-sectional view of an embodiment of a single or multi-tooth seal with magnetic adjustment.
Figure 4:
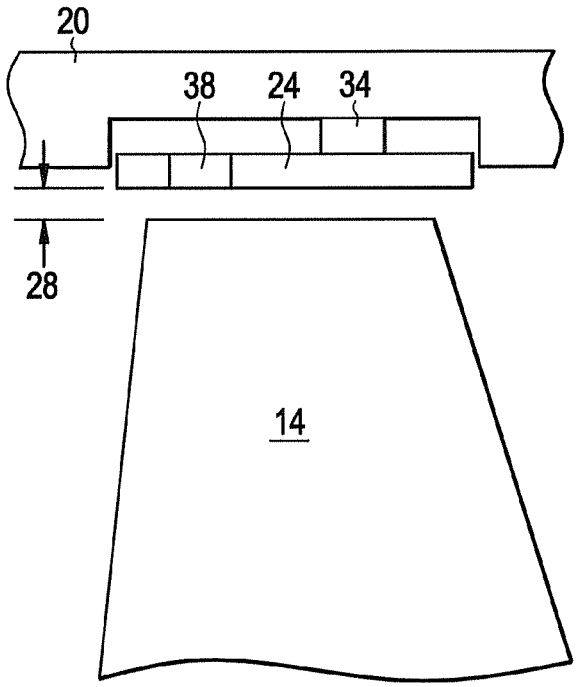
FIG. 4 is a cross-sectional view of an embodiment of a tip shroud with magnetic adjustment.

Shown in FIG. 1 is a cross-sectional view of an embodiment of a turbine 10 of, for example, a gas turbine or steam turbine. The turbine 10 includes a turbine rotor 12 having one or more rows of turbine buckets 14 arrayed circumferentially around a rotor disc 60. The rotor 12 is rotatable about a central axis 18 and is disposed in a casing 20. The turbine 10 includes one or more blade rows 22 which are disposed axially between rows of the turbine buckets 14. At least one tip shroud 24 is disposed radially outboard of each row of the one or more rows of turbine buckets 14. Each tip shroud 24 may be comprised of a plurality of shroud segments (not shown). The tip shroud 24 and the turbine buckets 14 define a tip clearance 28 therebetween, as best shown in FIG. 4. Referring again to FIG. 1, a ring of seals, for example, single or multi-tooth seals 30 may be disposed radially between each blade row 22 and rotating structure, for example, a rotating seal 16. The rotating seal 16 and the seals 30 define a rotor clearance 32 therebetween, as best shown in FIG. 2.

During operation of the turbine 10, it may be advantageous to change a position of the seals 30 to adjust the rotor clearance 32 during, for example, start up or shutdown of the turbine 10, or during transients. In these operating conditions, vibration and/or thermal growth of the components could lead to excessive wear of the seals 30. As shown in FIG. 2, at least one magnetic actuator 34 is disposed at the seal 30, in some embodiments fixed to a seal housing 36. The at least one magnetic actuator 34 is configured and disposed such that when an electric current is introduced to the magnetic actuator 34, a magnetic field is generated which causes the seal 30 to move away from the rotating seal 16 thus increasing the rotor clearance 32. Alternatively, the magnetic actuator 34 may be configured to move the seal 30 toward the rotating seal 16 when electrical current is introduced to the at least one magnetic actuator 34. It is to be appreciated that, while the electromagnetic actuator 34 of the embodiment of FIG. 2 is configured to move the seal 30 in a radial direction, it is to be appreciated that the electromagnetic actuator 34 may be configured to move the seal 30 in other directions, for example, an axial direction.

In some embodiments, at least one feedback device, for example at least one proximity sensor 38 is disposed at the seal 30. The proximity sensor 38 is disposed to measure and provide feedback on clearance between the seal 30 and the rotating seal 16. In some embodiments, the proximity sensor 38 is in operable communication with the at least one magnetic actuator 34 such that the magnetic actuator 34 moves the seal 30 based on feedback from the proximity sensor 38. Further, in some embodiments, one or more springs 40 may be disposed at a radially outward portion of the seal 30 to bias the position of the seal 30. The springs 40 may be configured to bias the position of the seal 30 in a direction to assist the magnetic actuator 34 in moving the seal 30, or to counter the magnetic actuator 34 in moving the seal 30.

Figure 3:
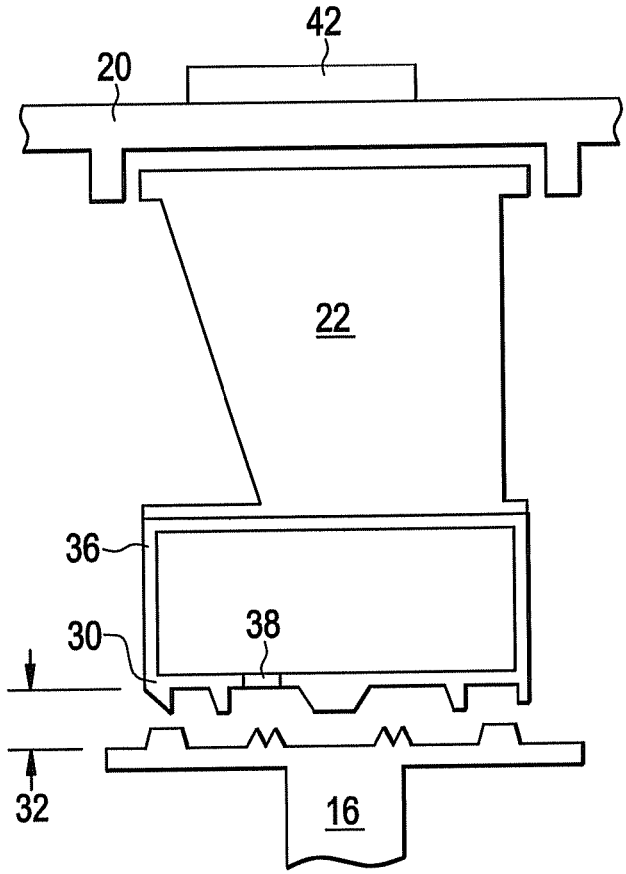
FIG. 3 is a cross-sectional view of another embodiment of a single or multi-tooth seal with magnetic adjustment.

In some embodiments, as shown in FIG. 3, a magnetic field may be utilized to move the seal 30 via at least one magnet 42 disposed outside of the casing 20. In some embodiments, the at least one magnet 42 is an electromagnet secured outside of the casing 20, such that when a magnetic field is generated by introducing electrical current to the magnet 42, the seal 30 is moved away from the magnet 42 by the magnetic field. In some embodiments, the magnet 42 moves the seal 30 by moving the blade row 22 associated with the desired seal 30 away from the magnet 42. It is to be appreciated that, in some embodiments, the magnet 42 may be configured to attract, rather than repel the blade row 22 and/or the seal 30 thus moving the seal 30 toward the magnet 42 when the magnetic field is generated. In the embodiment shown in FIG. 3, since the magnet 42 is disposed outside of the casing 20, there is no need to penetrate the casing 20 thereby reducing the potential for leakage from the casing 20, and simplifying fabrication of and reducing cost of the casing 20.

While the embodiments described to this point have utilized magnetic fields to move seals 30, magnetic fields may be utilized to move other components, for example, the at least one tip shroud 24. As shown in FIG. 4, at least one magnetic actuator 34 is disposed at the casing 20 and is configured to move the tip shroud 24 when the magnetic actuator 34 is activated to adjust the tip clearance 28. The magnetic actuator 34 may be configured to attract or repel the tip shroud 24 when activated, depending on the requirements of the particular turbine 10. In some embodiments, at least one proximity sensor 38 is disposed at the tip shroud 24 to measure the tip clearance 28. The magnetic actuator 34 may move the tip shroud 24 based on feedback from the proximity sensor 38.

Figure 5:
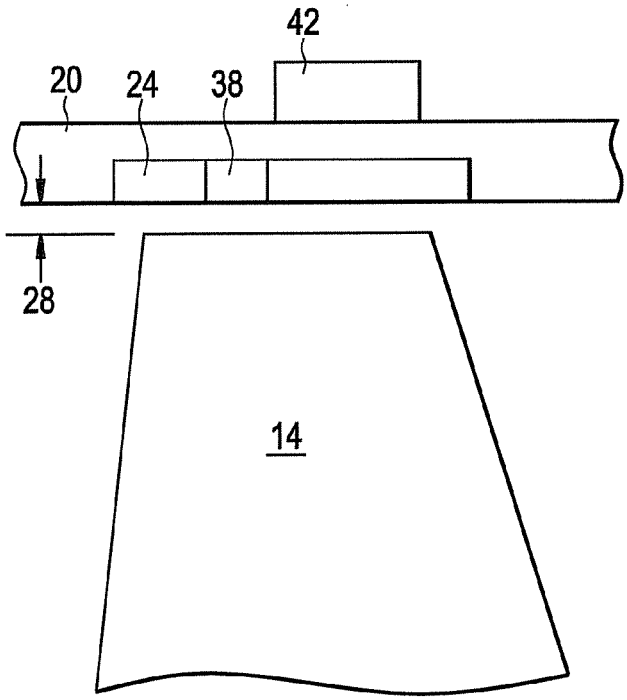
FIG. 5 is a cross-sectional view of another embodiment of a tip shroud with magnetic adjustment.

Further, as shown in FIG. 5, at least one magnet 42 disposed outside the casing 20 may be utilized to move the tip shroud 24 via the magnetic field created by the magnet 42. In the embodiment of FIG. 5, since the magnet 42 is disposed outside of the casing 20 there is no need to penetrate the casing 20 to allow access for components which move the ring of the tip shroud 24. This reduces leakage through the casing 20, and also simplifies and reduces cost of fabrication of the casing 20.

Figure 6:
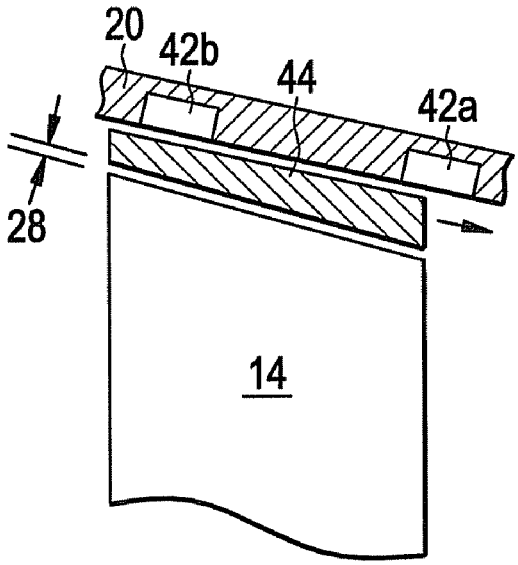
FIG. 6 is a cross-sectional view of another embodiment of a tip shroud with magnetic adjustment.
Figure 7:
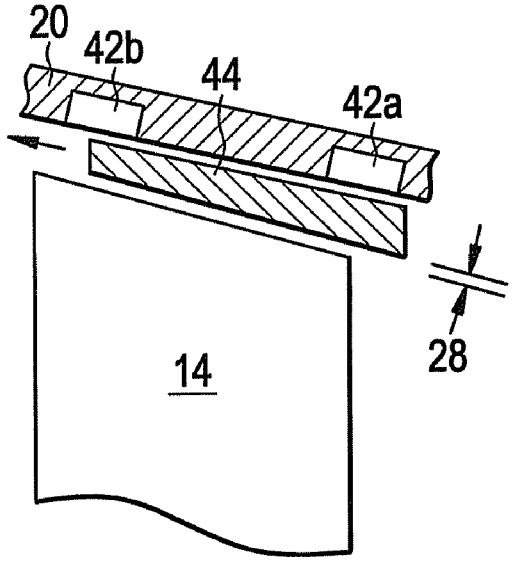
FIG. 7 is another cross-sectional view of the tip shroud of FIG. 6.

As shown in FIG. 6, at least one magnet 42 may be utilized to move a tapered seal 44 in an axial direction to adjust the tip clearance 28. The tapered seal 44 is positioned between the turbine buckets 14 and the casing 20. In the embodiment of FIG. 6, two magnets 42 are disposed at the casing 20. When an electrical current is provided to magnet 42*a*, a magnetic field is created which moves the tapered seal 44 in an axial direction toward magnet 42*a*, thus adjusting the tip clearance 28 from a closed condition as shown in FIG. 6 to an opened condition as shown in FIG. 7. With the tip clearance 28 in the opened condition, the electrical current to magnet 42*a* may be turned off, and an electrical current provided to magnet 42*b* to create a magnetic field which moves the tapered seal 44 toward magnet 42*b* thus adjusting the tip clearance from the opened condition to the closed condition shown in FIG. 6. Further, in some embodiments, the magnets 42*a* and 42*b* may be configured with switchable, opposing polarity. For example, magnet 42*a* may initially have a positive polarity and magnet 42*b* may have a negative polarity. To move the tapered seal 44 toward magnet 42*a*, both magnets 42*a* and 42*b* are energized, with magnet 42*a* attracting the tapered seal 44 and magnet 42*b* repelling the tapered seal 44 thus providing additional force to move the tapered seal 44 toward magnet 42*a*. To move the tapered seal toward magnet 42*b*, the polarities are reversed such that magnet 42*b* attracts the tapered seal 44 and magnet 42*a* repels tapered seal 44.

Figure 8:
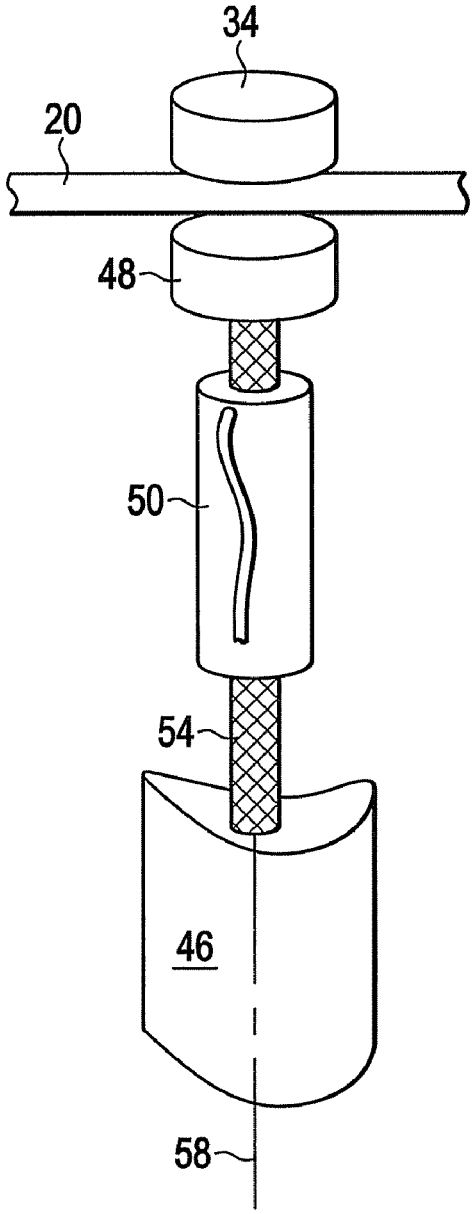
FIG. 8 is a view of a magnetically adjustable variable vane.
Figure 9:
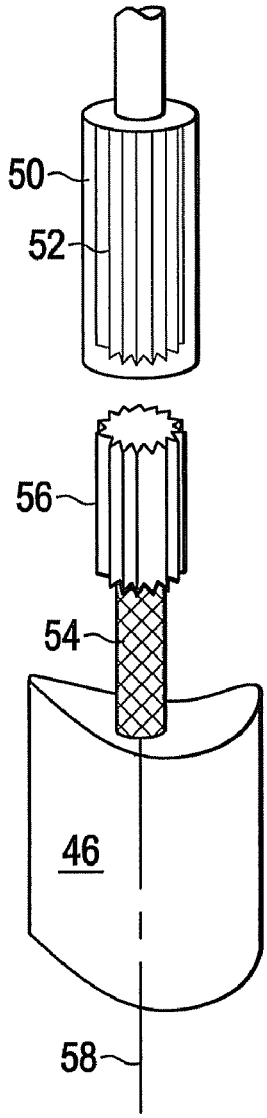
FIG. 9 is a partially exploded view of the variable vane of FIG. 8.

As shown in another embodiment shown in FIGS. 8 and 9, an electromagnetic actuator 34 may be utilized to adjust positions of gas path components such as rotating variable vanes 46. In the embodiment of FIG. 8, the electromagnetic actuator 34 is disposed outside of the casing 20, and is in magnetic communication with a target 48 disposed inside of the casing 20. The target 48 is connected to a slider-follower cam 50, which in this embodiment includes an internal spline 52, as best shown in FIG. 9. A slide connector 54 with a corresponding external spline 56 is inserted into the cam 50 and is connected to the variable vane 46. When the electromagnetic actuator 34 is activated, the target 48 is either attracted to or repelled from the electromagnetic actuator 34 along a slider axis 58. The movement of the target 48 along the slider axis 58 is translated into rotational motion of the variable vane 46 about the slider axis 58 via the cam 50. Although a slider-follower cam 50 is utilized in the embodiments of FIGS. 8 and 9, other means for translating linear motion to rotational motion, for example, a helical spline connection may be utilized. Some embodiments may include one or more springs (not shown) to return the variable vane 46 to a home position when the electromagnetic actuator 34 is deactivated. Further, reversing a polarity of the electromagnetic actuator 34 may also accomplish this function.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A seal for a turbomachine comprising:

at least one fixed component disposed proximate to a rotating component of the turbomachine defining a radial clearance therebetween; and at least one magnet disposed at the at least one fixed component, the at least one magnet, when activated, capable of moving the at least one fixed component thereby adjusting the radial clearance between the at least one fixed component and the rotating component.

2. The seal of claim 1 wherein the at least one magnet is a magnetic actuator.

3. The seal of claim 1 wherein the at least one magnet is disposed outside of a casing of the turbomachine.

4. The seal of claim 1 including at least one proximity sensor capable of detecting the clearance between the rotating component and the at least one fixed component.

5. The seal of claim 1 wherein the at least one fixed component is at least one multi-tooth seal.

6. The seal of claim 1 wherein the at least one fixed component is at least one tip shroud.

7. A turbomachine comprising:

a casing;

at least one rotating component disposed in the casing, the at least one rotating component rotatable about a central axis of the turbomachine;

at least one fixed component disposed in the casing to define a radial clearance between the at least one rotating component and the at least one fixed component; and at least one magnet disposed such that when the at least one magnet is activated, the radial clearance between the at least one rotating component and the at least one fixed component is adjusted.

8. The turbomachine of claim 7 wherein the at least one magnet is disposed outside of the casing.

9. The turbomachine of claim 7 wherein the at least one magnet is at least one magnetic actuator.

10. The turbomachine of claim 7 including at least one proximity sensor capable of detecting the radial clearance between the at least one rotating component and the at least one fixed component.

11. The turbomachine of claim 7 wherein the at least one fixed component is at least one multi-tooth seal.

12. The turbomachine of claim 11 wherein the radial clearance is between the at least one multi-tooth seal and a rotating seal.

13. The turbomachine of claim 7 wherein the at least one fixed component is at least one tip shroud.

14. The turbomachine of claim 13 wherein the clearance is between the at least one tip shroud and at least one row of turbine buckets.

15. A method for adjusting a position of at least one fixed component of a turbomachine comprising:

disposing at least one magnet proximate to the at least one fixed component having a radial clearance between the at least one fixed component and a rotating component;

activating the at least one magnet thereby creating a magnetic field in magnetic communication with the at least one fixed component; and moving the at least one fixed component via the magnetic field thereby adjusting the radial clearance between the at least one fixed component and the radial component.

16. The method of claim 15 wherein activating the at least one magnet comprises introducing electrical current to the magnet.

17. The method of claim 15 including detecting the radial clearance between the at least one fixed component and at least one rotating component.

18. The method of claim 17 including activating the at least one magnet in response to detecting the radial clearance between the at least one fixed component and the at least one rotating component.

19. The method of claim 17 wherein activating the at least one magnet reduces the radial clearance between the at least one fixed component and the at least one rotating component.

20. The method of claim 15 including disposing the at least one magnet outside of a casing of the turbomachine.

* * * * *